United States Patent [19]

Murphy

[11] Patent Number: 4,570,820

[45] Date of Patent: Feb. 18, 1986

[54] RESEALABLE DISPENSING CONTAINER FOR FOLDED TOWELS

[75] Inventor: Betty J. Murphy, Upper Montclair, N.J.

[73] Assignee: Creative Products Resource Associates, Ltd., Clifton, N.J.

[21] Appl. No.: 694,471

[22] Filed: Jan. 23, 1985

Related U.S. Application Data

[63] Continuation of Ser. No. 458,782, Jan. 18, 1983, abandoned.

[51] Int. Cl.[4] ..... B65H 1/00

[52] U.S. Cl. ..... 221/34; 221/63; 221/102; 221/135; 221/45; 206/210

[58] Field of Search ..... 221/33, 45, 47, 48, 221/50, 49, 52, 55, 56, 61, 63, 101, 102, 283, 154, 97, 34, 135; 222/107, 541; 206/210–361; 383/65

[56] References Cited

U.S. PATENT DOCUMENTS

| | | | |
|---|---|---|---|
| Re. 28,969 | 9/1976 | Naito . | |
| 1,764,673 | 6/1930 | Babson | 221/283 |
| 2,990,948 | 7/1961 | Zackheim | 206/46 |
| 3,057,467 | 10/1962 | Williams . | |
| 3,124,298 | 3/1964 | Repko | 221/63 |
| 3,174,644 | 3/1965 | Kaltman et al. | 221/63 |
| 3,269,593 | 8/1966 | Lodewick et al. | 221/63 |
| 3,278,085 | 10/1966 | Brown | 222/541 |
| 3,286,435 | 11/1966 | Weinberger | 53/117 |
| 3,325,003 | 6/1967 | Bilezerian | 206/57 |
| 3,836,045 | 9/1974 | Duhy | 221/63 |
| 3,907,164 | 9/1975 | Stich | 222/541 |
| 4,002,264 | 1/1977 | Marchesani | 221/63 |
| 4,017,002 | 4/1977 | Doyle et al. | 221/63 |
| 4,185,754 | 1/1980 | Julius | 221/63 |

FOREIGN PATENT DOCUMENTS

| | | | |
|---|---|---|---|
| 917049 | 1/1963 | United Kingdom | 221/63 |
| 1546433 | 5/1979 | United Kingdom . | |

*Primary Examiner*—H. Grant Skaggs
*Attorney, Agent, or Firm*—Kenyon & Kenyon

[57] ABSTRACT

This invention relates to a container for a stack of folded, preferably treated, towels, comprising a flexible, water-impermeable envelope having in the interior space thereof a movable apertured stiffening plate.

10 Claims, 4 Drawing Figures

RESEALABLE DISPENSING CONTAINER FOR FOLDED TOWELS

This is a continuation of a co-pending application Ser. No. 458,782 filed on Jan. 18, 1983 and now abandoned.

BACKGROUND OF THE INVENTION

This invention relates to a disposable, resealable container for dispensing folded, treated towels. Most disposable containers for dispensing disposable folded tissues or towels are made of thin paperboard or cardboard and are not suitable for containing the liquids or waxes used to saturate cleaning or moisturizing towels, or are not readily reclosable (U.S. Pat. No. 2,990,948). Such towels are commonly sealed individually within foil packages or envelopes such as described in U.S. Pat. No. 3,057,467, or may be packaged in bulk in a plastic jug or tub as described in U.S. Pat. Nos. 4,017,002, 3,325,003 and 3,836,045. These existing packages are either relatively expensive in material or not as convenient to store or use as might be desired. One attempt to solve these problems involves sealing the towels in a flexible envelope of aluminized plastic, such as is employed to hold Johnson's Baby Wash Cloths® (Johnson and Johnson, New Brunswick, N.J.). However, once this envelope is opened, it is difficult to reseal, and the towels, once removed, are difficult to reinsert. A further problem arises in that the progressive removal of the towels decreases the rigidity of the package, which tends to collapse.

An object of this invention is, therefore, to provide a relatively simple and economical disposable container for retaining and dispensing treated, folded towels.

It is another object of the present invention to provide a flexible container for treated towels which substantially retains its shape as the towels are removed, and allows for their easy reinsertion into the container.

It is another object of the present invention to provide a container for folded, treated towels which is easily resealable, so as to prevent the contamination of unused towels, and to prevent the loss of the volatile ingredients used to treat the towels when the towels are stored between uses.

BRIEF DESCRIPTION OF THE INVENTION

In accord with the present invention, a container for a stack of folded, preferably treated, towels is provided comprising a flexible, water-impermeable envelope having in the interior space thereof a movable apertured stiffening plate. The plate is of an area substantially equivalent to one surface of the envelope and one surface of the towel stack and is positioned between the towel stack and the surface of the envelope so that the aperture is aligned with an opening in the surface. The towels are stacked and sized so as to be sequentially removable through the aperture and the envelope opening. Two closure member strips are attached adjacent to the edges defining said opening in opposed fashion and are adapted so as to interlock and seal said opening under conditions of pressure.

To manufacture flexible, resealable envelops useful in the practice of the present invention, a pair of strips bearing complementary, interlockable fastening members may be attached to one face of a square or rectangle of sheet material adjacent to opposite parallel edges. Such member-bearing strips are disclosed in U.S. Pat. No. Re. 28,969, the disclosure of which is incorporated herein by reference and are commonly integrally molded from flexible plastic. The sheet may be folded to engage the fastening members, so as to form an open-ended envelope such as those disclosed in British Pat. No. 1,546,433, the disclosure of which is incorporated herein by reference. In accordance with the practice of the present invention, a pack of folded towels may be inserted along with an apertured stiffening plate which abuts the upper surface of the envelope, i.e. the surface incorporating the engaged closure member strips. The open ends of the envelope may then be closed, i.e., by a crimping, heat-sealing or adhesive process, to complete the manufacture of the dispensing container. In addition, the edges of the envelope adjacent to the engaged fastening members may also be sealed together, i.e., by crimping, or heat-sealing or by means of an adhered tear-strip, or the like.

When it is desired to remove one or more towels from the container, the interengaged fastening members are separated, e.g., by opposed finger pressure, and the towels separated from the stack and pulled out of the container interior through the resulting opening and through the aperture in the stiffening plate below, which abuts said opening. After use, the towels may be discarded, or alternatively, may be reinserted into the container interior so as to be retained between the stiffening member and the upper container surface. The container may then be resealed, and the towels retained within the container for future use.

The dispensing containers of the present invention preferably further include a means for hanging or suspending the container, i.e., within the tub or shower area, so that the towels may be conveniently removed for application of the treating agent, as after bathing. In one embodiment of the present invention, the treating agent is a mixture of emollients adapted to moisturize wet skin surfaces.

BRIEF DESCRIPTION OF THE FIGURES

Novel features and advantages of the present invention will become apparent to one skilled in the art from a reading of the following description in conjunction with the accompanying figures wherein similar reference characters refer to similar parts and in which.

DESCRIPTION OF THE PREFERRED EMBODIMENT

Figure 1:
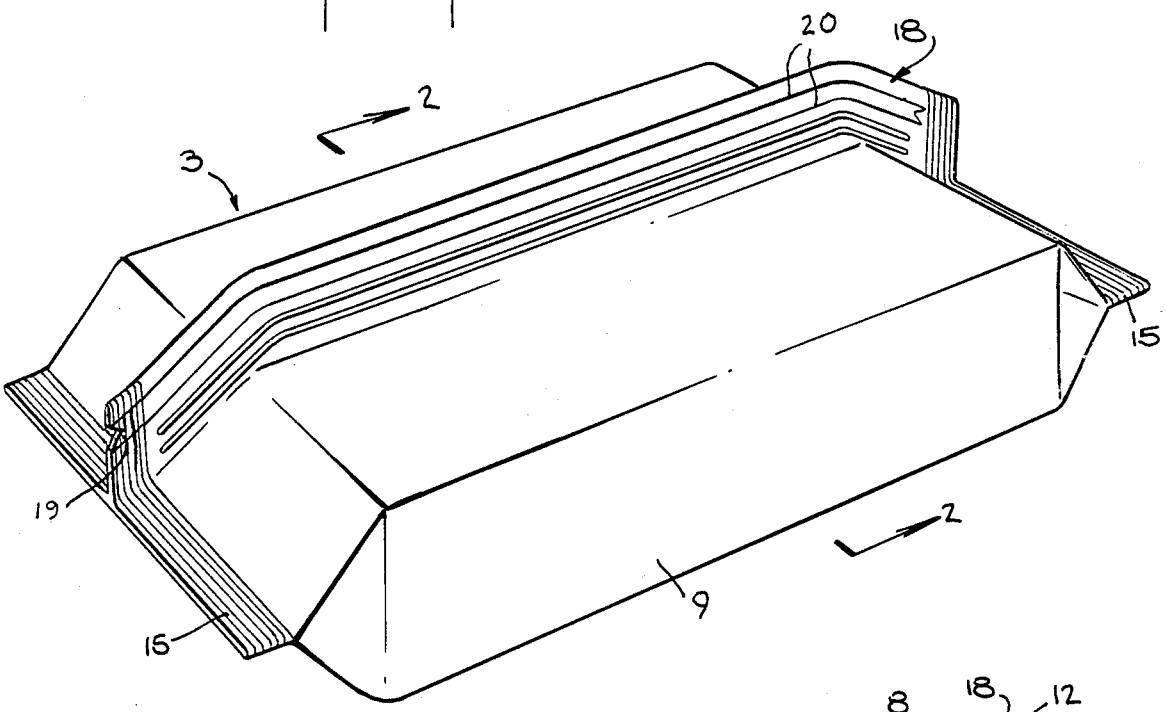
FIG. 1 is a top perspective view of a sealed container which is one embodiment of this invention.

In FIG. 1 is shown the outer envelope 9 of the sealed container 3 for dispensing a stack of folded towels, not shown, which is contained therein. Preferably the envelope 9 is filled so as to have two substantially parallel, rectangular or square top and bottom surfaces and two substantially parallel, rectangular or square side walls. The top or upper surface of the envelope includes an opening (shown sealed into a flange 18) which, preferably, is centered on one axis of the upper envelope surface. As shown, the top and bottom envelope surfaces are sealed together at their narrower parallel edges to form crimped end walls 15 of the envelope. Preferably, the outer envelope is formed of a moisture and vapor impermeable, flexible sheet material such as aluminum foil, plastic, or a composite aluminum-plastic, aluminum-paper or plastic-paper sheet material. Thus, the envelope may be made of a metallic foil which may have a thermoplastic coating, such as polyethylene, applied to the inner surface thereof. Preferably, the envelope is formed from a metallized sheet of a plastic such as polyethylene terephthalate which is laminated with a thin layer of polyethylene on its interior surface.

Figure 3:
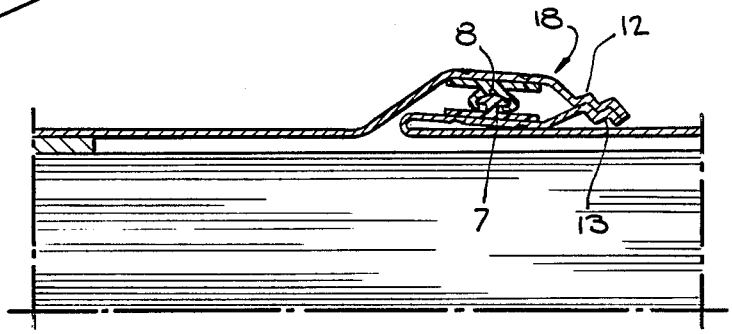
FIG. 3 is a fragmentary, cross-sectional view of FIG. 2, showing an alternate means for sealing the edges of the envelope opening.
Figure 2:
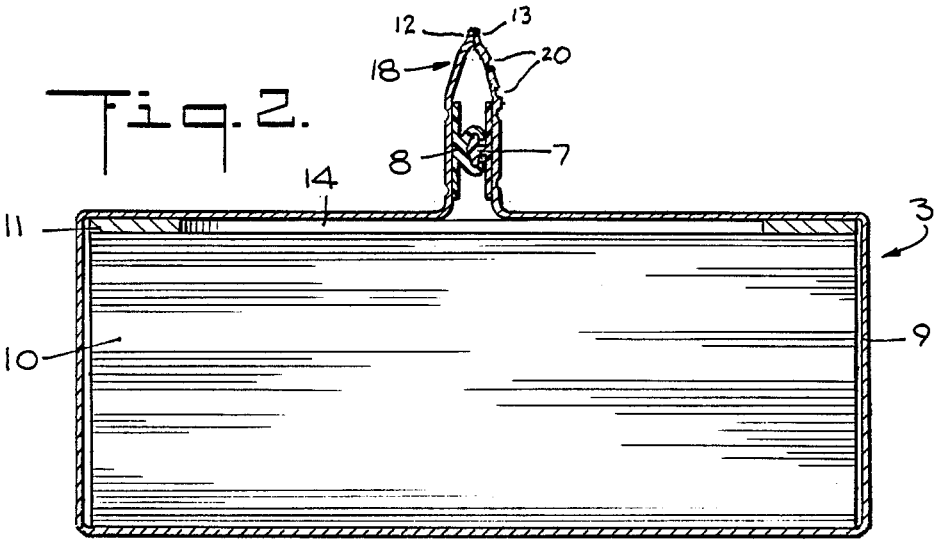
FIG. 2 is a front, cross-sectional view taken through FIG. 1 along line 2-2.

FIG. 2 is a cross-sectional view of the sealed container 3 taken through line 2—2 of FIG. 1 which depicts the envelope 9 enclosing a stack of folded towels 10 which are positioned under an apertured plate 11. Plate 11 acts to shape and stiffen the envelope and provides an opening 14 through which the towels may be sequentially removed. FIG. 2 illustrates the preferred closure means for the envelope 9, whereby two interlockable closure members, 7 and 8, which as shown are male and female members, respectively, are engaged so as to seal the opening in the upper surface of the envelope. The envelopes preferred for the container of the present invention are preferably formed from one sheet of flexible material having a pair of interlockable closure members 7 and 8 attached as continuous strips to one face, positioned in an adjacent fashion to opposite, parallel edges 12 and 13 of the sheet. The sheet is then folded around the objects to be encompassed therein, or around a similarly shaped template, and the closure member strips interlocked to form an envelope having two open ends. Once the towel stack and plate are positioned within the envelope as shown in FIG. 2, the open ends are closed, i.e., by a crimping or gluing process to form the crimped end walls 15, thus completing the manufacture of the container 3 of the present invention. The edges of the envelope, 12 and 13 which are adjacent to the closure strips, may be left unconnected, or may be joined by a suitable adhesive, or by heat-sealing so as to form a flange, 18 which acts to protect the closure members 7 and 8 from accidental disengagement and to protect the towels from contamination prior to use, or from depletion of the treating material by leakage or evaporation. When interengaged and closed in this manner, or by crimping, as shown in FIG. 3, the adjacent envelope surfaces are drawn together into a flange 18, which is oriented perpendicularly to the upper envelope surface as depicted in FIG. 2, but which may be folded so that it is substantially parallel to the envelope surface as shown in FIG. 3, thus further sealing the envelope contents.

FIG. 1 illustrates a preferred means whereby a portion of flange 18 may be removed so as to expose members 7 and 8. This means consists of forming a notch 19 at one end of flange 18 at a point between sealed edges 12 and 13 and members 7 and 8. Notch 19 provides the beginning of a tear which assists tearing away flange 18 thus exposing members 7 and 8. Flange 18 may alternatively or additionally be perforated or scored on one or both sides along a line or lines running parallel to and between the sealed portion of the flange and the closure members as indicated by score marks 20, so that it can more easily be torn away to expose members 7 and 8.

Figure 4:
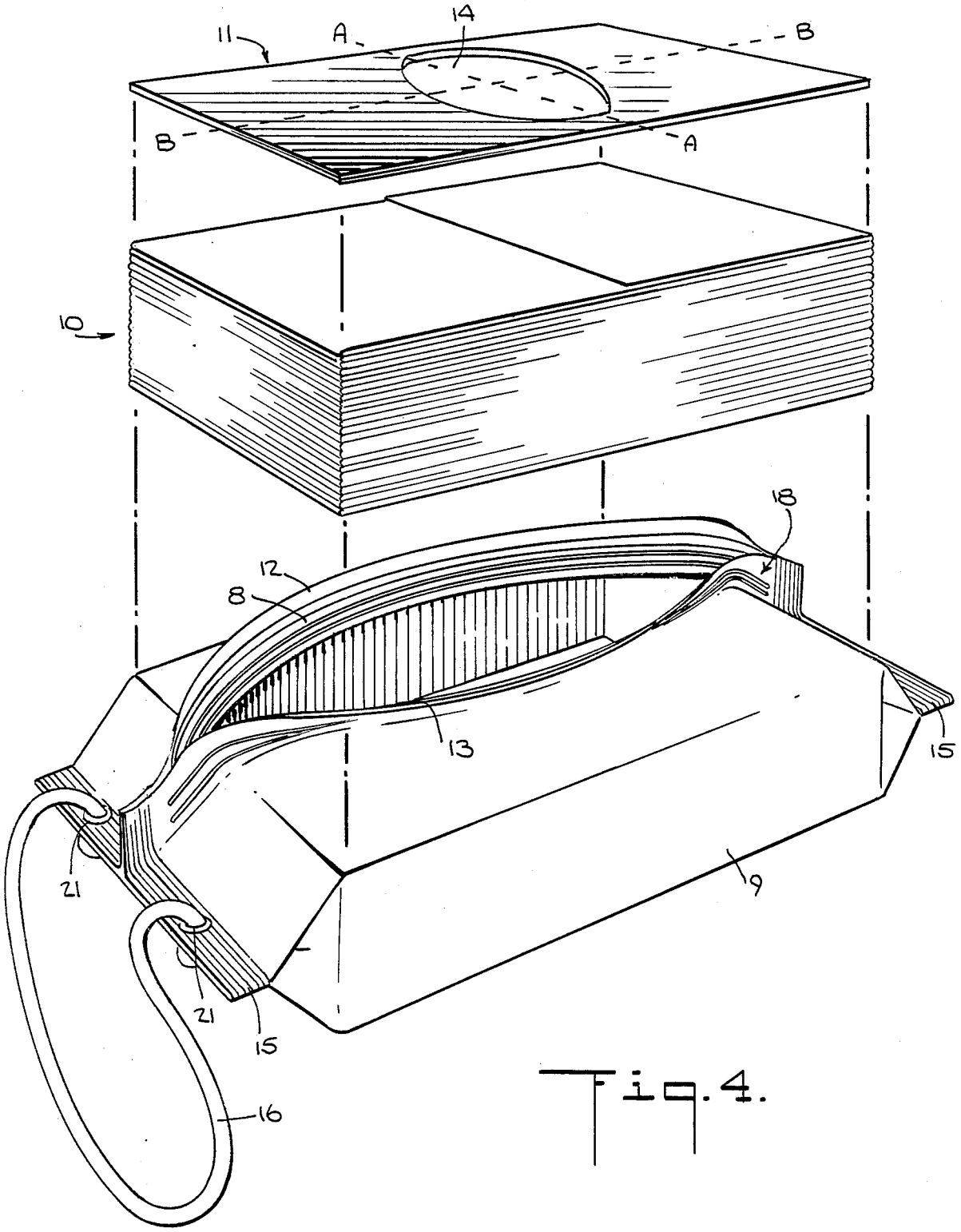
FIG. 4 is an exploded top perspective view of an open container which is one embodiment of this invention, showing the stack of folded towels and the interior, apertured plate through which the towels are dispensed.

FIG. 4 is an exploded, perspective view of one embodiment of the container 3 of the present invention, depicting the envelope 9 in an open position, after the upper, sealed portion of flange 18 has been removed, and the edges 12 and 13 of the envelope opening separated. One closure member strip 8 is shown in an unengaged position. The stack of folded towels 10 is depicted as positioned beneath the apertured plate 11.

In accord with the present invention, one of the crimped edges 15 of the envelope may be perforated, and one or more eyelets 21 affixed, so as to permit the attachment of a plastic or cord loop 16 for suspending the container in the bathing area.

In accord with a preferred embodiment of the present invention, the stack of towels is impregnated with an oil-in-water emulsion of moisturizing or cleansing agents. The impregnation is accomplished before the stack of towels is inserted into the interior of the envelope. One convenient procedure for filling the envelope is to first partially complete the envelope, then to insert the treated stacked towels into the envelope, and then to complete the sealing of the envelope by crimping the open edges closed to formed crimped edges 15 as shown in FIGS. 1 and 4.

The towels may be of any convenient size for personal skin care use, i.e., for moisturizing skin surfaces such as the hands and feet, and may be of any fabric of sufficient tensile strength and absorbtivity to carry an effective amount of the treating agent. Preferred treating agents are oil-in-water emulsions comprising one or more emollients. A preferred fabric is a nonwoven fabric of synthetic textile fibers, but paper or foam sheets may be useful as carriers for some agents, especially those which are rich in volatile components.

The individual towels are stacked so that they may be sequentially separated from the stack and removed from the container via the aligned aperture and opening under a slight withdrawal pressure, as by pinching and pulling with the fingers. The stiffening plate may be formed from any rigid or slightly flexible material such as plastic, coated cardboard, fiberboard and the like. Preferably, the plate is rectangular and is substantially equal in dimension to the upper surface of the towel stack 10 and to the upper envelope surface.

The plate aperture 14 may be of any shape of sufficient size to permit the facile removal of the individual towels. Preferably, the aperture is centered on the plate and is oval in shape, with the greater diameter being nearly equal to one axis, i.e. A, of the rectangular upper envelope or towel stack surface. Geometrically-formed, i.e., rectangular, and lobular cross-shaped apertures may also be employed.

In practice, the user would align flange 18 perpendicularly to the envelope surface as shown in FIG. 1, use notch 19 to tear away a portion of the flange wall between sealed edge 13 and member 7, separate edges 12 and 13, and disengage closure member strips 7 and 8, thus opening the container envelope 9. The user would then insert his fingers through the aperture 14 in the stiffening plate 11 and sequentially remove one or more of the stacked, treated towels from stack 10. After use, the towel could be discarded, or reinserted through the opening so as to be secured between the envelope surface and the plate. The closure member strips 7 and 8 would then be pressed together so as to reseal the container and protect the towels until their next use. As individual towels are progressively removed from the envelope and the stack depleted, the stiffening plate 11 will act to prevent the envelope from folding or crumpling, thus facilitating the removal of all of the towels.

In describing the container of the present invention, a particular embodiment has been given for the purposes of illustration; also the container has been described with the preferred method of sealing. The invention, however, is not limited to the specific embodiment used to describe the same, but is only limited in accordance with the claims.

What is claimed is:

1. A flexible container containing a stack of towels and adapted for dispensing said towels comprising a moisture impermeable flexible envelope having a resealable opening and said envelope having in the interior space thereof a movable aperatured stiffening plate of an area substantially equivalent to one surface of said envelope and one surface of said towel stack, said plate being positioned between said towel stack surface and said envelope surface so that said aperture is aligned with said resealable opening in the envelope surface, and said towels being stacked and sized so as to be sequentially removable through said aperture and said opening, and said opening having two opposed edges equipped with opposed closure member strips which are attached adjacent to said edges and are adapted so as to interlock and seal said opening under pressure; wherein said resealable opening is centered on an axis of said envelope surface and is large enough to permit a removed towel to be reinserted between said surface and the stiffening plate; a pair of crimped end walls at opposing ends of said resealable opening, and at least one of said end walls having means for suspending said container attached thereto; and wherein said edges may be sealed together so as to form a flange which acts to cover and protect said interlocked closure members.

2. The container of claim 1 further comprising a means to assist the removal of the sealed portion of said flange so as to expose said closure members.

3. The container of claim 2 wherein said means for assisting the removal of the sealed portion of said flange comprise a notch positioned at one end of said flange at a point between said sealed edges and said closure members.

4. The container of claim 1 wherein said means for suspending said container comprise a plastic loop attached to one or more eyelets set into a crimped edge of said envelope.

5. The container of claim 1 further comprising an impregnating agent absorbed in said towels, said impregnating agent comprising one or more emollients, and said envelope being substantially impervious to air.

6. The container of claim 1 wherein said envelope is formed of a metallized plastic sheet.

7. The container of claim 6 wherein the metallized plastic sheet comprises a metal foil having a thermoplastic coating.

8. The container of claim 7 wherein the metal foil comprises aluminum and the thermoplastic is selected from the group consisting of a polyethylene and polyethylene terephthalate.

9. The container of claim 6 wherein the metallized plastic sheet comprises a metallized sheet of polyethylene terephthalate having a surface laminated with a thin layer of polyethylene.

10. The container of claim 1 wherein the opening extends along a major portion of said axis.

* * * * *